US011840880B2

(12) United States Patent
Lain

(10) Patent No.: US 11,840,880 B2
(45) Date of Patent: Dec. 12, 2023

(54) PET PORTAL

(71) Applicant: Suzanne Eva Lain, Grandby, MA (US)

(72) Inventor: Suzanne Eva Lain, Grandby, MA (US)

( * ) Notice: Subject to any disclaimer, the term of this patent is extended or adjusted under 35 U.S.C. 154(b) by 0 days.

(21) Appl. No.: 17/820,091

(22) Filed: Aug. 16, 2022

(65) Prior Publication Data

US 2022/0412157 A1 Dec. 29, 2022

Related U.S. Application Data

(63) Continuation-in-part of application No. 17/038,400, filed on Sep. 30, 2020, now abandoned.

(60) Provisional application No. 62/914,586, filed on Oct. 14, 2019.

(51) Int. Cl.
*E06B 7/32* (2006.01)

(52) U.S. Cl.
CPC ..... *E06B 7/32* (2013.01)

(58) Field of Classification Search
CPC ..... E06B 2009/002; E06B 9/04; E06B 9/02; E06B 7/32; A01K 29/00
See application file for complete search history.

(56) References Cited

U.S. PATENT DOCUMENTS

| | | | | | |
|---|---|---|---|---|---|
| 2,124,525 | A * | 7/1938 | Frankel | E06B 7/30 | 49/171 |
| 2,758,646 | A * | 8/1956 | Johnson | E06B 7/32 | 160/90 |
| 2,832,406 | A | 4/1958 | Turenne | | |
| 4,022,263 | A * | 5/1977 | Beckett | E06B 7/32 | 160/180 |
| 4,331,254 | A * | 5/1982 | Haggerty | F16L 5/02 | 312/1 |
| 4,350,198 | A * | 9/1982 | Naegeli | E06B 7/32 | 160/DIG. 8 |
| 4,938,169 | A | 7/1990 | Barmakian | | |
| 6,634,407 | B1 * | 10/2003 | Strohmeyer | E06B 7/32 | 160/180 |
| 8,495,835 | B2 * | 7/2013 | Timmons | E06B 7/32 | 160/180 |
| 9,145,731 | B1 * | 9/2015 | McCoy | A01K 1/035 | |
| 11,209,083 | B2 * | 12/2021 | Gandolfo | F16J 15/022 | |
| 2012/0137586 | A1 | 6/2012 | Timmons | | |
| 2019/0110437 | A1 * | 4/2019 | Watchorn | A01K 13/002 | |

* cited by examiner

*Primary Examiner* — Justin B Rephann
(74) *Attorney, Agent, or Firm* — Kathleen Kuznicki; The Lynch Low Grove, LLC

(57) ABSTRACT

Disclosed is a pet portal that allows various sizes of pets to easily enter/exit a house through a baffle opening and trap tunnel. The baffle opening made out of a flexible insulating material that bounces back into its original shape after being disturbed when an animal passes through the portal. While in the closed orientation, the baffle material blocks the outdoor environment, maintaining a constant and comfortable temperature inside the house and prevent entry of insects.

6 Claims, 13 Drawing Sheets

PET PORTAL

This continuation-in-part nonprovisional application claims priority to U.S. application Ser. No. 17/038,400 filed on Sep. 30, 2020, which in turn claims priority to provisional application Ser. No. 62/914,586 filed on Oct. 14, 2019. Both applications are fully incorporated in this disclosure.

FIELD OF INVENTION

The invention is an alternative to traditional pet doors.

BACKGROUND OF THE INVENTION

People like to let their pets come and go quickly from inside the house at all hours and during all seasons. Many types and styles of pet doors are on the market to accommodate this need. These previous doors have many drawbacks. Some pet doors have an opening without any cover, which, when not in use, results in drafts/outdoor environment and insects entering the house. Many traditional pet doors employ a swinging, rigid, rectangular flap made of either plastic, vinyl, or rubber. To minimize drafts/outdoor environment from coming indoors, they either rely on the stiffness/rigidity and weight of the flap to close the opening after a pet goes through, or they may utilize magnets or other mechanical means to seal the opening closed. These traditional pet doors also allow insects to invade homes too easily. Some, more modern cat doors, employ a four-way, mechanical, hard-plastic flap, which often breaks over time and requires human intervention to lock/unlock. There is also electromagnetic technology which requires a pet to wear a collar and for the magnet on the collar to be facing forward at all times. Or there are microchip-locking mechanisms which are expensive and require pets to have an embedded microchip.

What is needed is a pet portal that allows various sizes of pet generally, up to 32 lbs. to easily enter/exit a house through an opening, but at the same time utilize paired sets of dual flush baffle sheets. These baffles create a trap tunnel that impedes the outdoor environment from entering the residence, maintaining a constant and comfortable temperature inside the house all year long (thus, saving valuable energy and money) and preventing insects and debris from entering.

While there are previous devices that use a baffle opening through a base or a door, none offer the advantages of the current claimed device.

U.S. Pat. No. 2,832,406 discloses an animal entrance, but the baffle opening design is cumbersome and less efficient. It is a single baffle panel with triangular flaps; however, each flap partially overlaps its neighboring flap. This design is more complicated to fabricate. The baffle panel slides into vertical slots on a frame with a bottom stop, not a design with self-contained indoor and outdoor sections or a streamlined portal design with only rounded edges exposed. Even though there is a tunnel present within a base, it does not function as a trap tunnel as the outside environment will be brought in while the animal is traversing the tunnel and entering the residence.

The device in U.S. Pat. No. 4,938,169 is intended for a different purpose and therefore has different design features. It is designed for grooming an animal and not designed for protecting the indoor of a residence against outdoor weather/bugs/debris. There is no trap tunnel, just a small space between the baffle panels because of their bristles. The baffle sheets cannot be flush because of the bristles and, therefore, the closed orientation is not fully closed. With the bristles, bugs and debris become trapped (as well as animal fur) and the baffles will easily become dirty and either need to be cleaned often or the dirt and debris will eventually make its way into the residence. Because of the bristles and the nature of the material, in that it needs to have some stiffness to withstand grooming the animal, this makes it less easy for an animal to traverse on a regular basis, and the animal probably would avoid or be discouraged to use it over time.

US20120137586 is a single baffle design for an arm access for an operator to insert a gas detection device. Having two sets of dual flush baffle sheets would be inhibitory to the purpose of this device. All components of this device are layered and there are no inset pieces, so it is not self-contained and is not contoured for guiding and smoothness. While having a tunnel, it is not a trap tunnel; many design improvements would be necessary for animal traversing.

SUMMARY OF THE INVENTION

Disclosed is a pet portal that utilizes a baffle design for the openings. Each baffle comprises a flexible insulating material such as thermoplastic rubber, which is cut in such a way that it flexes both inward and outward as a cat/small pet comes and goes through it, after which the baffle springs back into place. The baffle design is biased to be in the closed orientation, with the triangular flaps sealing as they mate with one another, except when a pet is passing through.

SHORT DESCRIPTION OF FIGURES

FIG. 1B shows an embodiment of the pet portal in a window opening with a pet passing through.

DETAILED DESCRIPTION

Figure 1A:
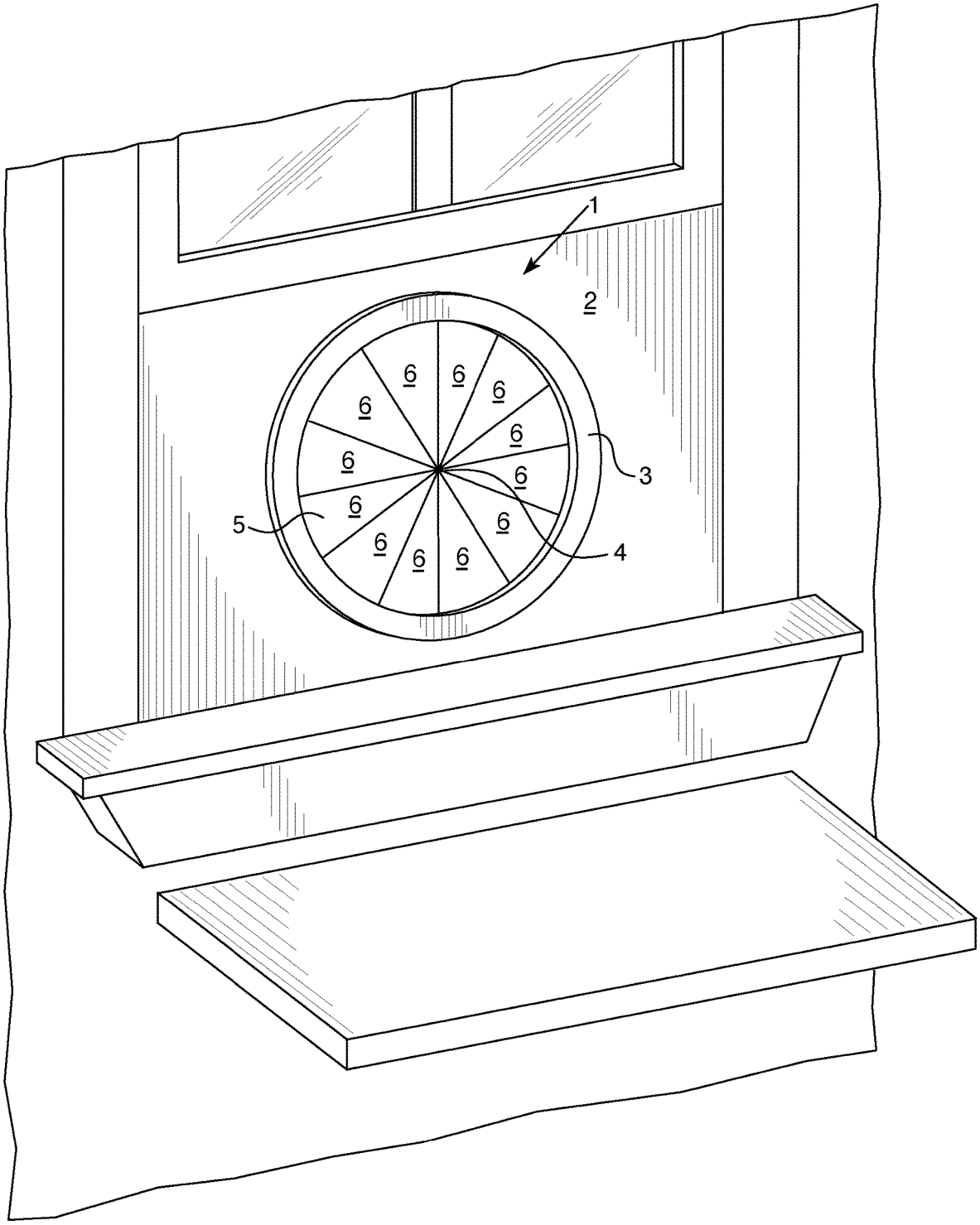
FIG. 1A shows an embodiment of the pet portal in a window opening in the closed orientation.

The pet portal of the claimed invention can be incorporated into either a window, a wall, or an interior/exterior door or wall of a house. Unlike traditional pet doors that comprise a hard, large, flapping rectangular piece of plastic, vinyl, rubber, or ones that have no barrier at all the pet portal of the claimed invention utilizes baffle style openings made of flexible insulating material such as thermoplastic rubber that can easily be traversed by a pet but does not require any accessories to enable a closed orientation when not in use. The closed orientation minimizes the entry of the outdoor environment, such as harsh weather and flying insects, into a residence.

The pet portal of the claimed invention is comprised of baffle openings made out of a flexible insulating material that bounces back into its original shape after being disturbed when an animal passes through the portal. The flexible insulating material is cut into triangular flaps such that the openings resemble a sliced pie where all points meet in the center. This design innately forms a barrier when in the closed orientation. The flexible insulating material can be attached by any means known in the art to any style of frame or a sectional half with openings shaped to accommodate the shape of the baffle openings. This frame or sectional half can, in turn, be attached to an outer surface, a base support for use with a window opening, or it can be directly inserted into an opening in a door or as a window insert, where they themselves act as a base support. A frame or sectional half that attaches to the outer surface of a base support can be various styles and shapes and can be plain, covered with decals, fabric, or other material. Preferably, for the safety of the animals, the sectional half is designed so that the animal is only ever exposed to rounded smooth surfaces and not any edges per se, which could catch the animal's fur and cause harm or pain to the animal.

Preferably, each baffle sheet has an opening formed by a plurality of triangular flaps and is configured in the pet portal as two sets of dual, flush, baffle sheets. Each baffle sheet comprises a plurality of triangular flaps that are cut like a pie so that all central vertexes meet in the center point to form a flexible barrier when in the closed orientation. The triangular flaps of each sheet in a set of dual, flush, baffle sheets are offset from one another, respectively. The gap or trap tunnel formed between the two sets of baffle openings will essentially only be the width of the door, wall, or window in which the pet portal is being used. Because of this baffle design, pets are able to navigate these openings quite easily. The advantage of using the two sets of dual baffle sheets is that there are now two barriers to prevent weather/insects from entering the house if being used to provide access to the exterior of the house. The triangular flaps of the baffle sheets are biased to be in a closed position except when an animal walks through them.

Figure 1B:
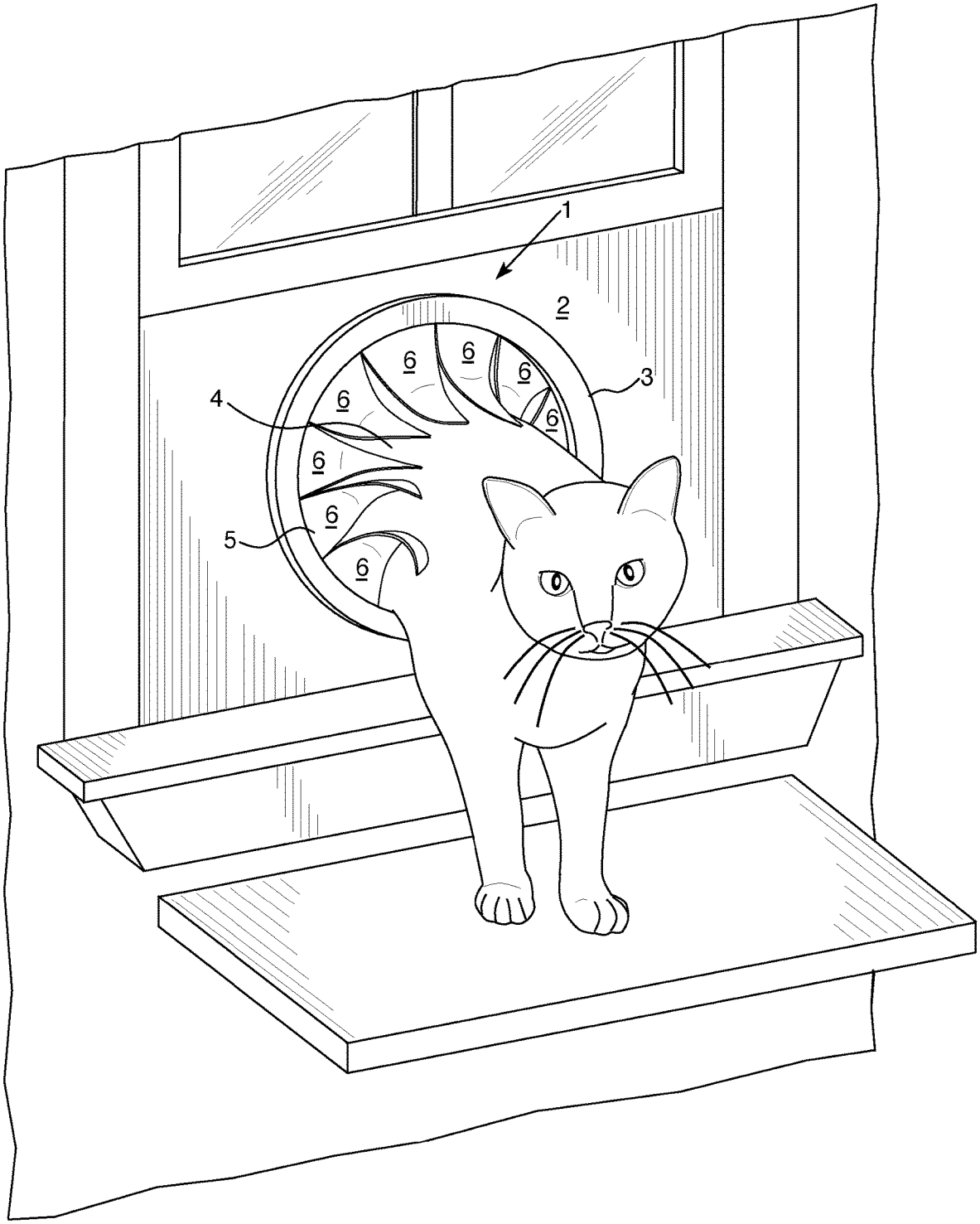

FIGS. 1A-1B disclose pet portal 1 for use with a window opening, with 1B and 1C showing an interior portal configuration shown from an interior view. Pet portal 1 is comprised of a base insert 2, external frame 3, and baffle material sheet 5 with baffle opening 4. Base insert 2 has a central opening that is sized to accommodate an animal the size of a typical household pet and base insert 2 is comprised of any suitable solid material cut to the size of a window opening. External frame 3 has an elliptical opening corresponding in size and shape of the diameter of the opening in the base insert 2 and can comprise any suitable material. Baffle opening 4 comprises triangular flaps 6 that are cut like a pie so that all central angled points meet in the center point to form a barrier when in the closed orientation. Baffle material sheet 5 is comprised of a flexible insulating material that is rigid enough so that the baffle is biased to be in the closed position except when a pet is passing through and is pliable enough to allow a typical household pet to navigate through the baffle opening. External frame 3 can attach to baffle material sheet 5 by any means known in the art. Baffle opening 4 is corresponding in size and shape of the diameter of the opening in the base insert 2; alternatively, baffle opening 4 could be slightly smaller to allow for an uncut edge to provide stability. Alternatively, the base insert can be used with a door opening rather than a window opening.

Figure 1C:
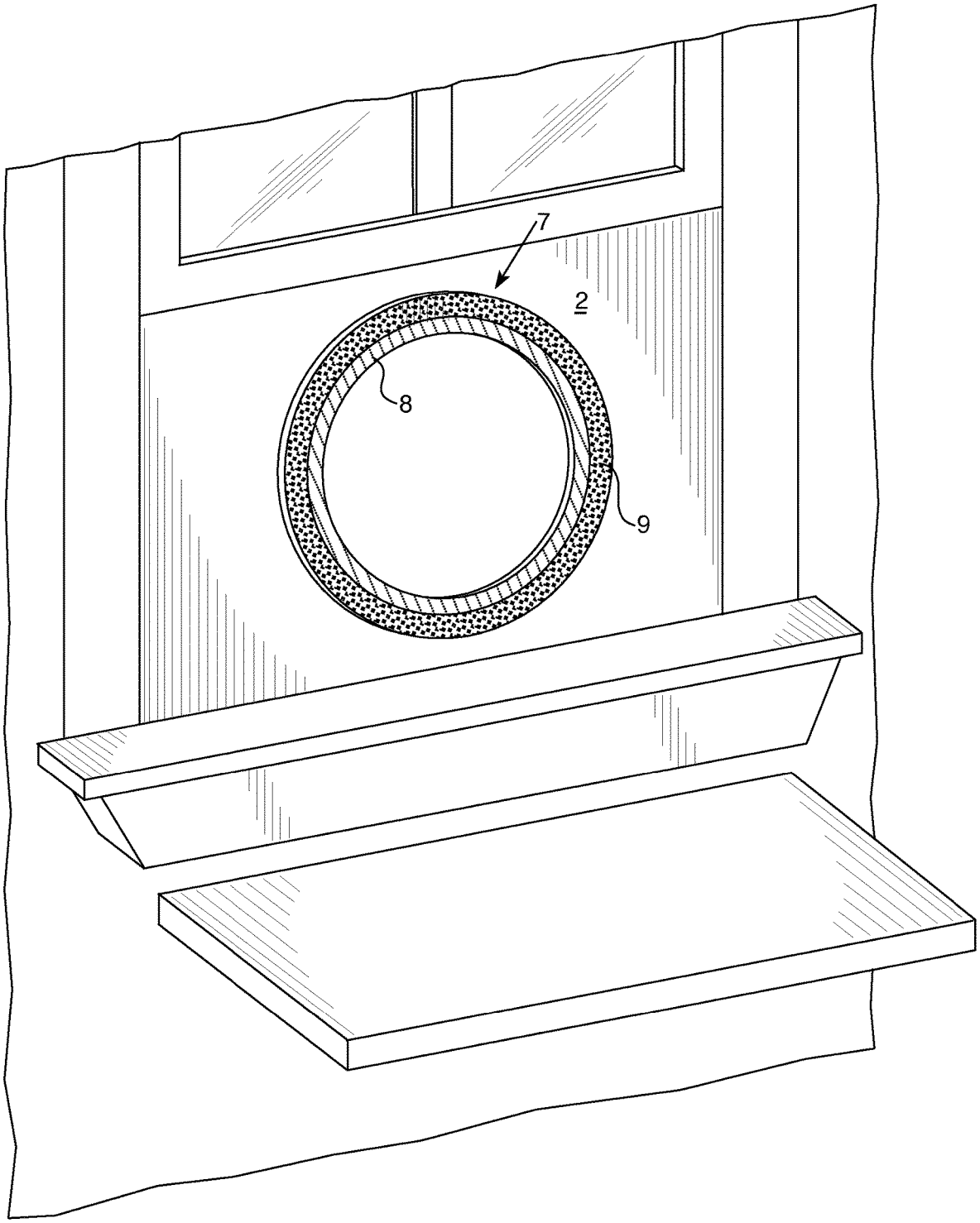
FIG. 1C shows an inner protective layer covering the opening of the base, with the frame and baffle opening removed.

As seen in FIG. 1C, optionally, an inner protective layer 7 has a diameter corresponding in size and shape to a diameter in an opening in a base and the inner protective layer 7 has an interior width piece 8 that corresponds to the width of the base insert 2, the inner protective layer 7 having external flaps 9 attached to the interior width piece 8, the external flaps 9 being capable of attaching to the base window insert via an area adjacent to the base opening. Inner protective layer 7 can be comprised of any material suitable. Inner protective layer 7 can attach to the base window insert by any means known in the art. Preferably, inner protective layer 7 is a circular piece of strong but flexible plastic that forms a safe pass-through along the inside of the base opening, which opening is hidden after the external frame(s) are attached.

Here is the portal configuration as shown on the interior; optionally, the portal configuration can be placed on the exterior of the base window insert. Either configuration forms a single baffle portal. Alternatively, portal configuration can be placed on both the exterior and the interior forming a double baffle portal.

As shown here, the baffle material sheet 5 is positioned in between the external frame 3 and base insert 2. Optionally (not shown), the baffle material sheet 5 can be positioned on the outward-facing surface of the external frame 3, wherein a stabilizer ring (not shown) corresponding in size and shape of each external frame 3 is placed on the outward-facing surface of the baffle material sheet 5, with the stabilizer ring aligning with its corresponding external frame.

Figure 2:
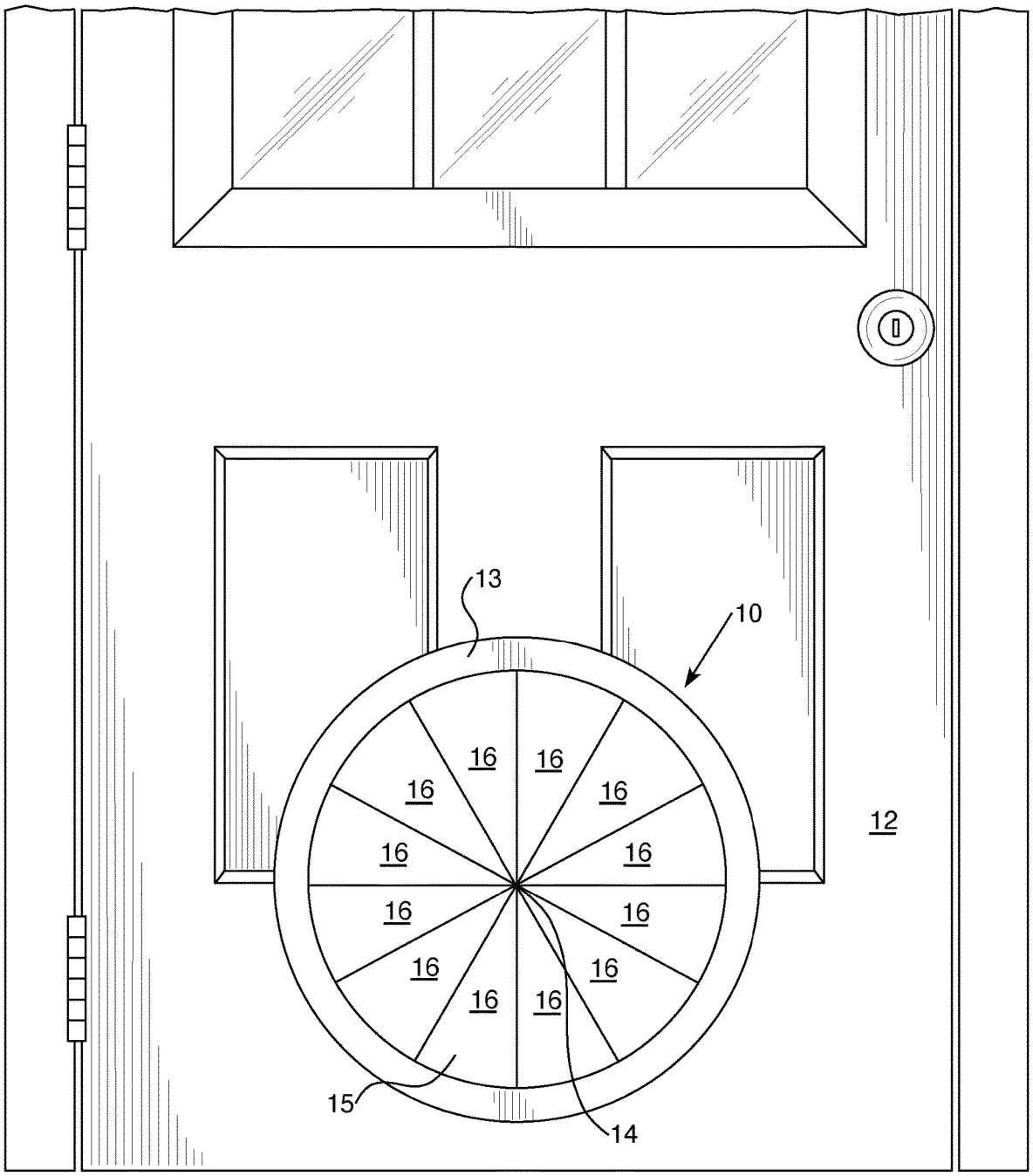
FIG. 2 shows an embodiment of the pet portal in the closed orientation when incorporated into a door.

FIG. 2 discloses pet portal 10 for use with a door 12 acting as a base, showing an interior portal configuration shown from an interior view. Pet portal 10 is comprised of an external frame 13, and baffle material sheet 15 with baffle opening 14. Door 12 has an opening that is sized to accommodate an animal the size of a typical household pet. External frame 13 has an elliptical opening corresponding in size and shape of the diameter of the opening in the door 12 and can comprise any suitable material. Baffle opening 14 comprises triangular flaps 16 that are cut like a pie so that all central-angled points meet in the center point to form a barrier when in the closed orientation. Baffle material sheet 15 comprises a flexible insulating material that is rigid enough so that the baffle is biased to be in the closed position except when a pet is passing through and is pliable enough to allow a typical household pet to navigate through the baffle opening. External frame 13 can attach to baffle material sheet 15 by any means known in the art. Baffle opening 14 is corresponding in size and shape of the diameter of the opening in the door 12; alternatively, baffle opening 14 could be slightly smaller to allow for an uncut edge to provide stability.

Here is the portal configuration as shown on the interior; optionally, the portal configuration can be placed on the exterior of the door base. Either configuration forms a single baffle portal. Alternatively, portal configuration can be placed on both the exterior and the interior, forming a double-baffle portal.

As shown here, the baffle material sheet 15 is positioned in between the external frame 13 and door 12. Optionally (not shown), the baffle material sheet 15 can be positioned on the outward-facing surface of the external frame 13, wherein a stabilizer ring (not shown) corresponding in size and shape of each external frame 13 is placed on the outward-facing surface of the baffle material sheet 15, with the stabilizer ring aligning with its corresponding external frame.

Similar to the window insert embodiment in FIG. 1C, in this door embodiment, preferably there is an inner protective layer that has a diameter corresponding in size and shape to a diameter in the opening in the door and that has an interior width piece that corresponds to the width of the door being used. The inner protective layer has external flaps attached to the interior width piece, with the external flaps being capable of attaching to the door via an area adjacent to the door base opening. The inner protective layer can comprise any material suitable. Preferably, the inner protective layer is a circular piece of strong but flexible plastic that forms a safe pass-through along the inside of the base opening, which opening is hidden after the external frame(s) are attached.

Figure 3A:
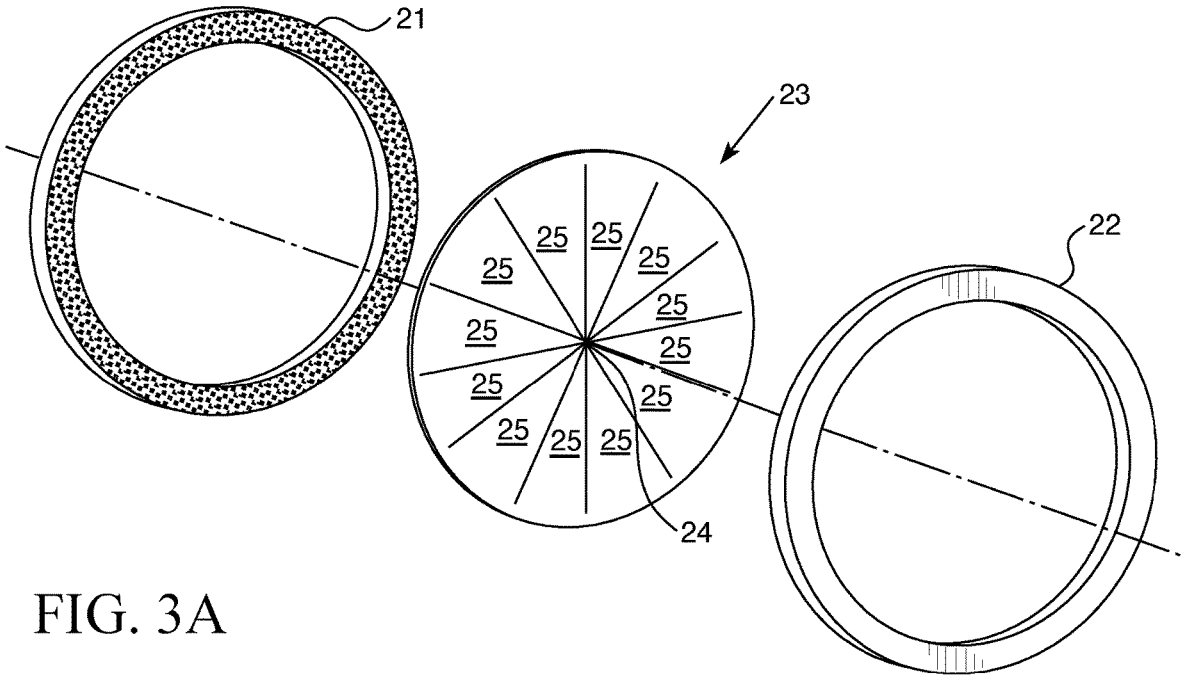
FIG. 3A is an exploded view of the slide unit insert.
Figure 3B:
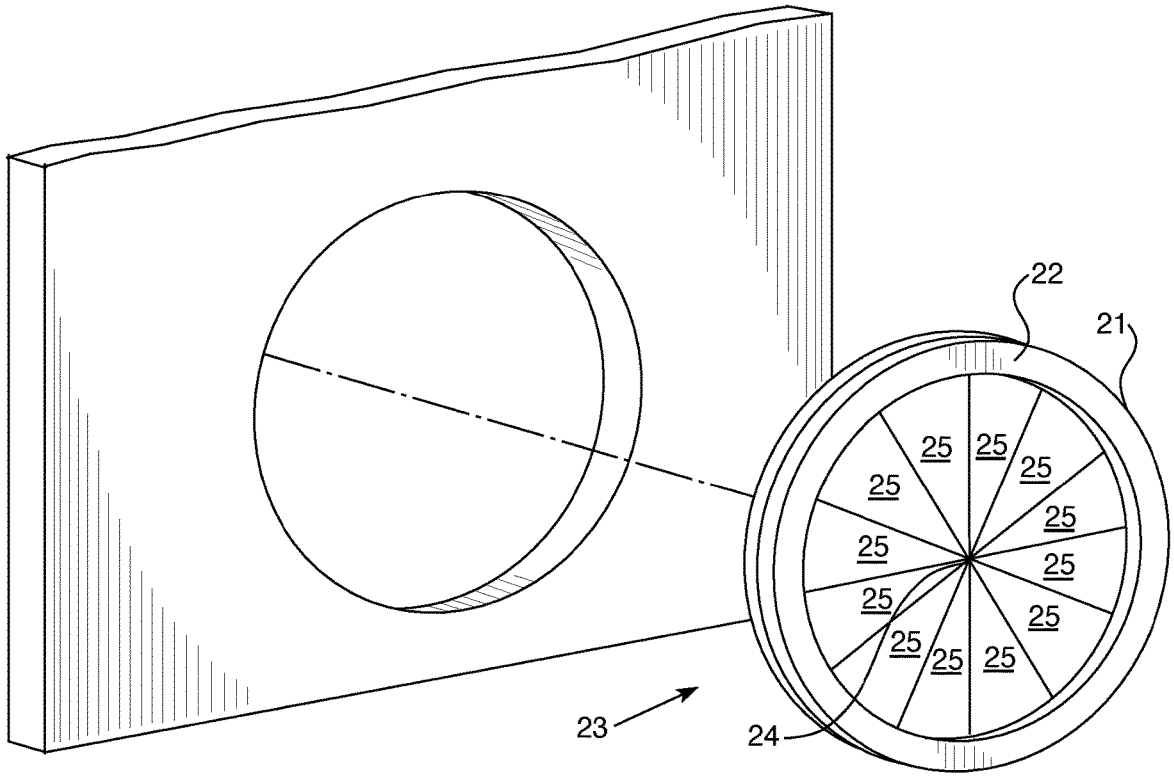
FIG. 3B shows the slide unit being inserted in an opening.

FIGS. 3A-3B disclose an independent portal unit that can be inserted into an opening such as an opening in a door. Pet portal unit 20 is comprised of an interior frame 21 with an elliptical opening corresponding in size and shape to a diameter of an opening in the base and capable of being inserted in an inner diameter in the opening in the base. The elliptical opening being sized to accommodate an animal the size of a typical household pet. Pet portal unit 20 has at least one attachment frame 22 with an outer diameter and an interior diameter with an elliptical opening, the outer diameter corresponding in size and shape to the outer diameter of the interior frame 21, the attachment frame 22 capable of being inserted in the inner diameter in the opening in the base, and the elliptical opening in the attachment frame 22 corresponding in size and shape to the elliptical opening of the interior frame.

The interior side of the attachment frame 22 is connected to baffle material sheet 23, which in turn is connected to the interior frame 21 such that the elliptical opening of the attachment frame 22 and the elliptical opening of the interior frame are aligned and the outer diameter of the attachment frame 22 and the outer diameter interior frame 21 are aligned. The attachment frame 22 being attached to a baffle material sheet 23, the baffle material sheet being comprised of baffle opening 24, the baffle opening 24 being elliptical in shape and the baffle opening 24 having a center point and comprising a plurality of triangular flaps 25, each triangular flap comprising a central, angled-shaped point such that each one of the central, angled-shaped points meets in the center point of the baffle opening 25 to form a barrier when in a closed orientation, the baffle material sheet 23 comprising a flexible insulating material, the baffle opening 24 being sized to accommodate an animal the size of a typical household pet and whereby the flexible insulating material is pliable enough to allow a typical household pet to navigate through the baffle opening 24, and whereby the flexible insulating material is rigid enough so that the baffle opening 24 is biased to be in the closed orientation when not in use.

As shown here, the baffle material sheet 23 is positioned on the inward-facing side of the attachment frame 22. In an alternative configuration, the baffle material sheet 23 can be attached to the outward facing of the attachment ring, and a stabilizer ring (not shown) corresponding in size and shape of each attachment frame 22 can be placed on the outward facing surface of the baffle material sheet 23, and the stabilizer ring aligning with its corresponding outward surface of the attachment frame.

Here, the portal configuration is shown that when inserted, the baffle opening 24 would be facing the exterior; optionally, the portal configuration can be reversed, where the baffle opening 24 would be on the interior of the door base. Either configuration forms a single baffle portal. Alternatively, portal configuration can be placed on both the exterior- and the interior-facing sides, forming a double-baffle portal.

Similar to the base insert embodiments, an inner protective layer can be used, such that it has a diameter corresponding in size and shape to a diameter in the opening in the door and has an interior width piece that corresponds to the width of the door. The inner protective layer has external flaps attached to the interior width piece, with the external flaps being capable of attaching to the door via an area adjacent to the door base opening. The inner protective layer can comprise any material suitable. Preferably, the inner protective layer is a circular piece of strong but flexible plastic that forms a safe pass-through along the inside of the base opening, which opening is hidden after the external frame(s) are attached. Here the inner protective layer can be used to ease the insertion of the pet portal unit 20 when assembled.

Figure 7A:
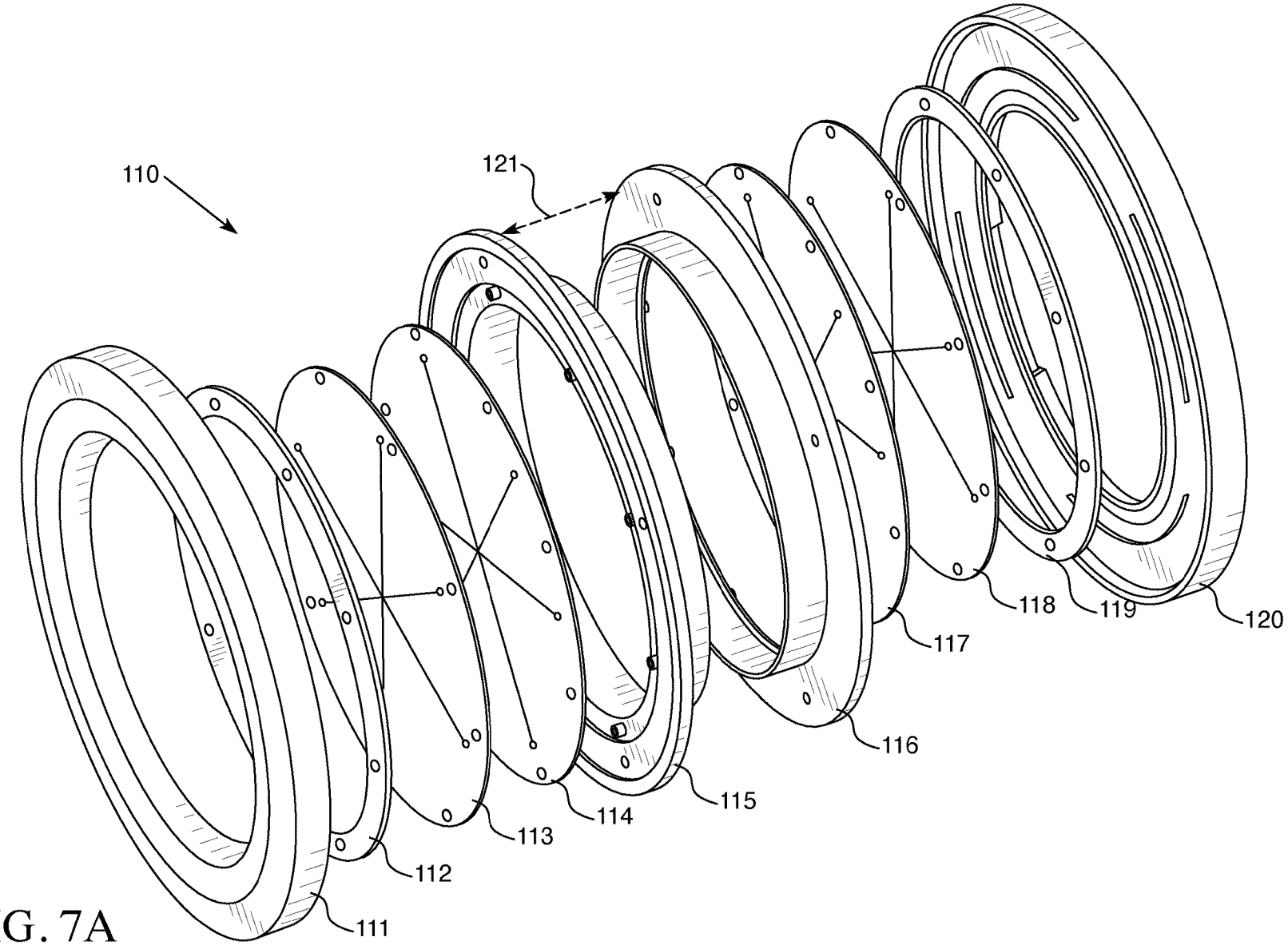
FIG. 7A shows an exploded view of an embodiment of the pet portal.
Figure 7B:
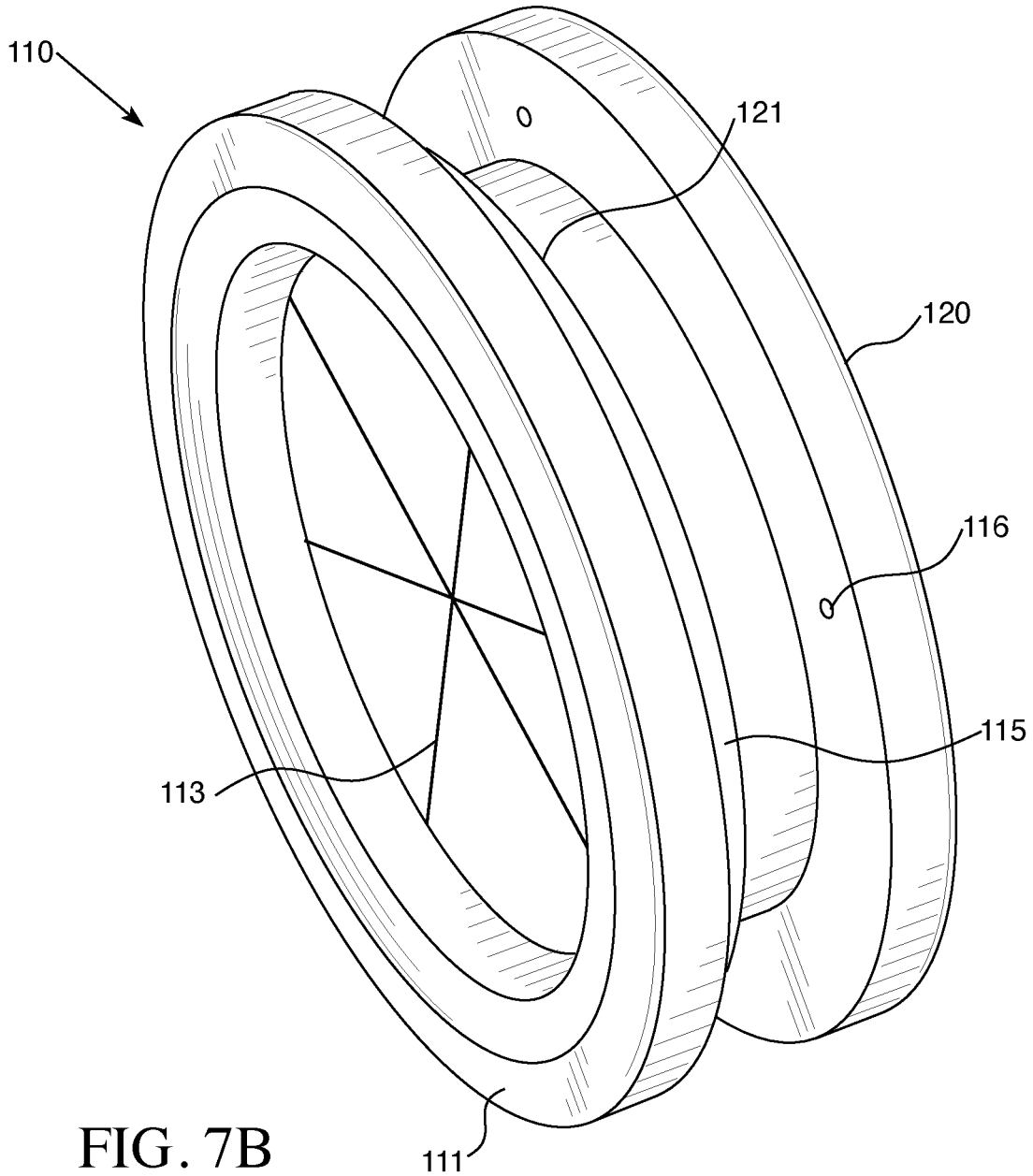
FIG. 7B shows an embodiment of an assembled pet portal.

Another nonlimiting embodiment of the pet portal can be seen in FIGS. 7A and 7B. FIG. 7B discloses an assembled pet portal 110. Though the device is being shown here without the base for clarity, pet portal 110 can be used within a base such as a door or a window insert similar to the door or window insert shown in FIGS. 1A, 1B, 1C, and 2. The pet portal 110 has two sectional halves and each sectional half comprises faceplates (111, 120), baffle support rings (112, 119), baffle sheets (113, 114, 117, 118), and connectors (115, 116). In this embodiment, the two sectional halves cooperate to form a trap tunnel within the base. These sectional halves can cooperate, as a nonlimiting example, by having connector 116 partially inserting into connector 115, with the base forming trap-tunnel 121 in this nested configuration. The sectional halves can also cooperate to form a trap tunnel by having the connector tubes matching up in size and abutting against one another within the base in a mirrored configuration. The elliptical openings of all the components of the pet portal are configured to align and are sized to accommodate an animal weighing up to about 32 lbs. (the size of a large cat or a small dog) and will be consistent in size throughout the individual components of the device.

Figure 4A:
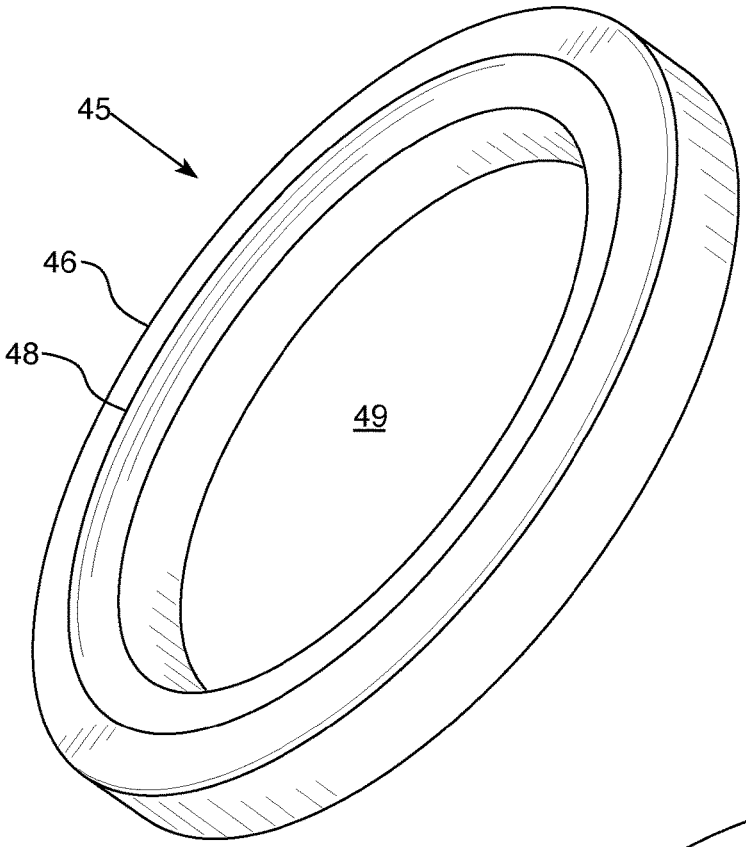
FIG. 4A shows a first embodiment of a front side of a faceplate.
Figure 4B:
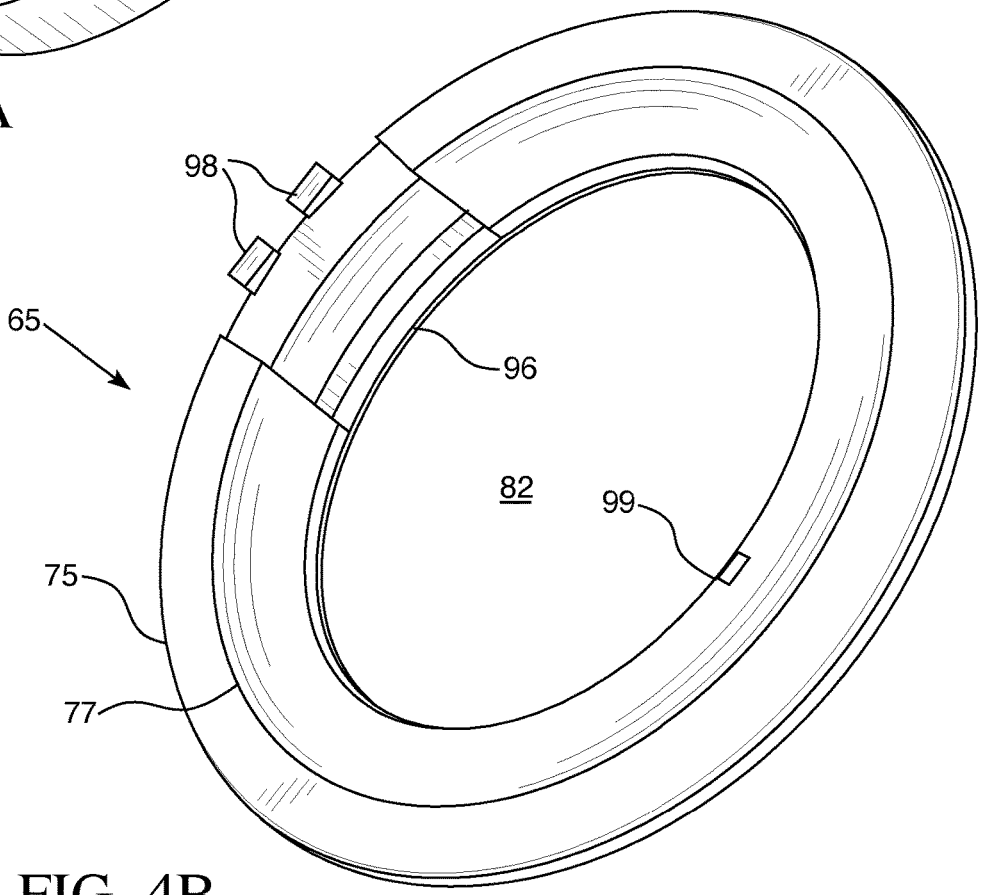
FIG. 4B shows a second embodiment of a front side of a faceplate.
Figure 4C:
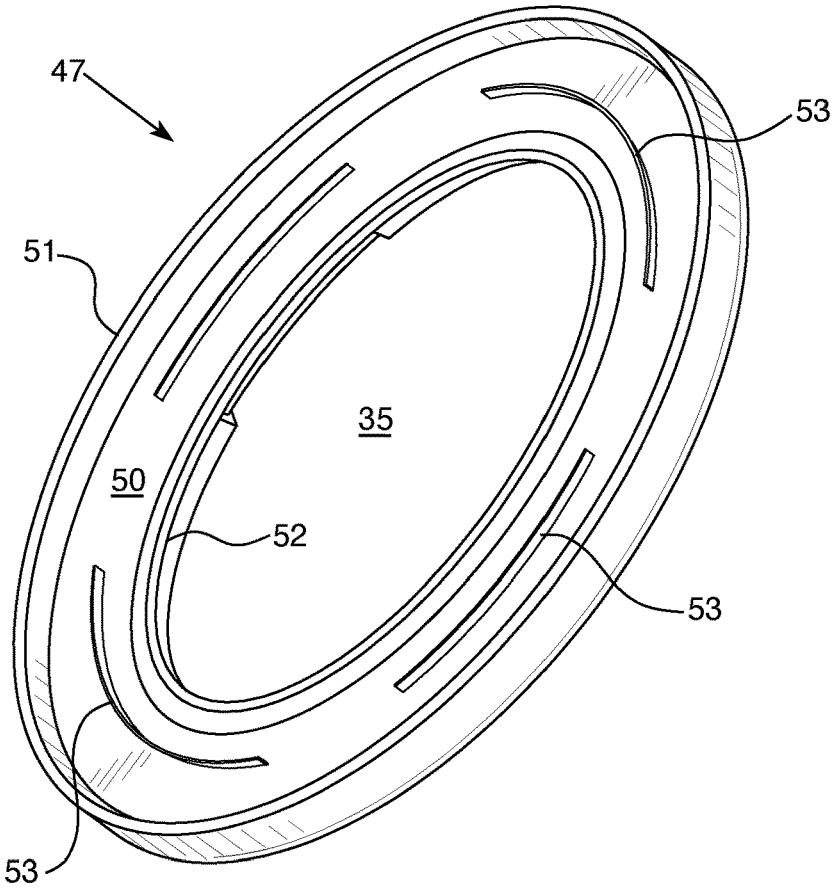
FIG. 4C shows a first embodiment of a back side of a faceplate.
Figure 4D:
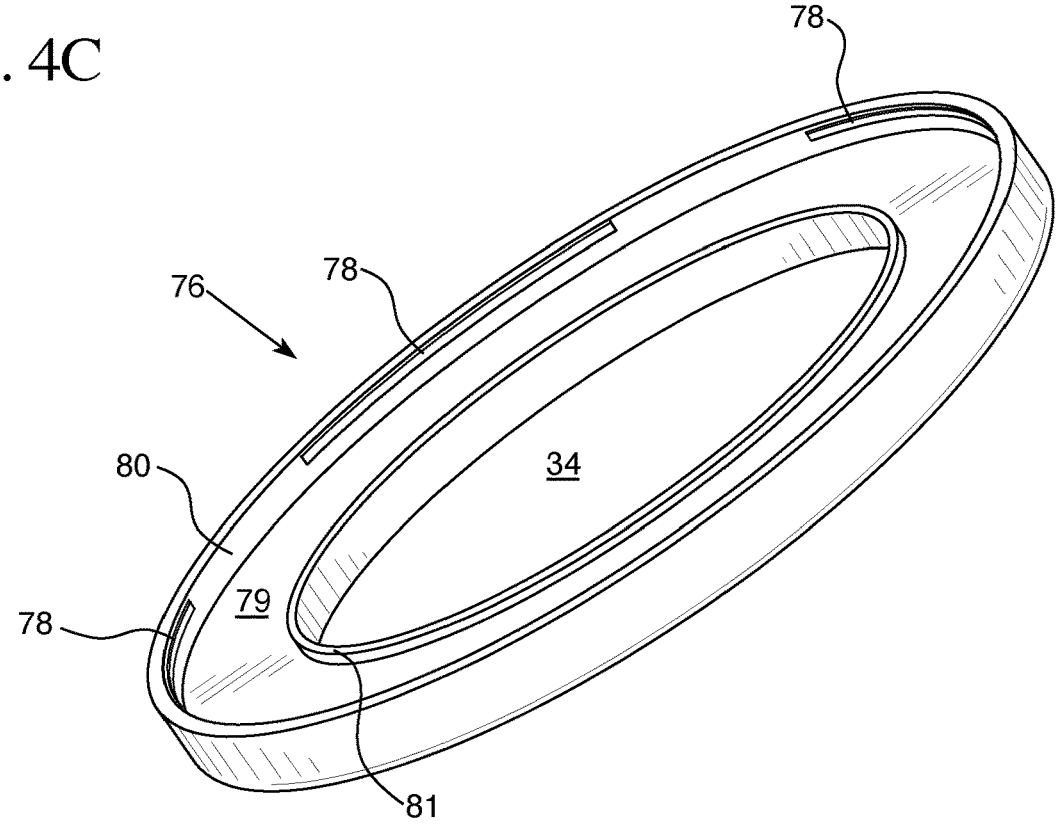
FIG. 4D shows a second embodiment of a backside of a faceplate.

FIGS. 4A-D disclose nonlimiting embodiments of a faceplate showing alternative front (4A, 4B) and back (4C, 4D) designs for the faceplate. In FIG. 4A, for faceplate 45, the front side 46 is a contoured convex ring 48 forming a relief down to an elliptical opening 49. In FIG. 4B, for faceplate 65, the front side 75 is a contoured convex ring 77 forming a relief down to an elliptical opening 82, wherein the contoured convex ring 77 further comprises a recess 96, sized and shaped to accommodate a door hinge, with the recess 96 also having cylinder-shaped insets 98 to accommodate the door hinge. The faceplate 65 can further comprise a second recess 99, that can accommodate a slide-bolt latch of a door. In FIG. 4C, the backside 47 comprises a recess 50 with a deep side-barrier 51 and a short side-barrier 52, that forms elliptical opening 35; the backside 47 further comprising a plurality of holders 53 within the recess 50, with the holders 53 allowing the backside 47 to be reversibly secured to a connector component of the pet portal. In FIG. 4D, the backside 76 comprises a recess 79 with a deep side-barrier 80 and a short side-barrier 81 that form elliptical opening 34; the backside 76 further comprising a plurality of holders 78 on the deep side-barrier, with the holders 78 allowing the backside 65 (FIG. 4B) to be reversibly secured to a connector component of the pet portal. Any front and back design can be paired together to make a faceplate for the pet portal, and any configuration of faceplates can be used to make a complete pet portal.

Figure 5A:
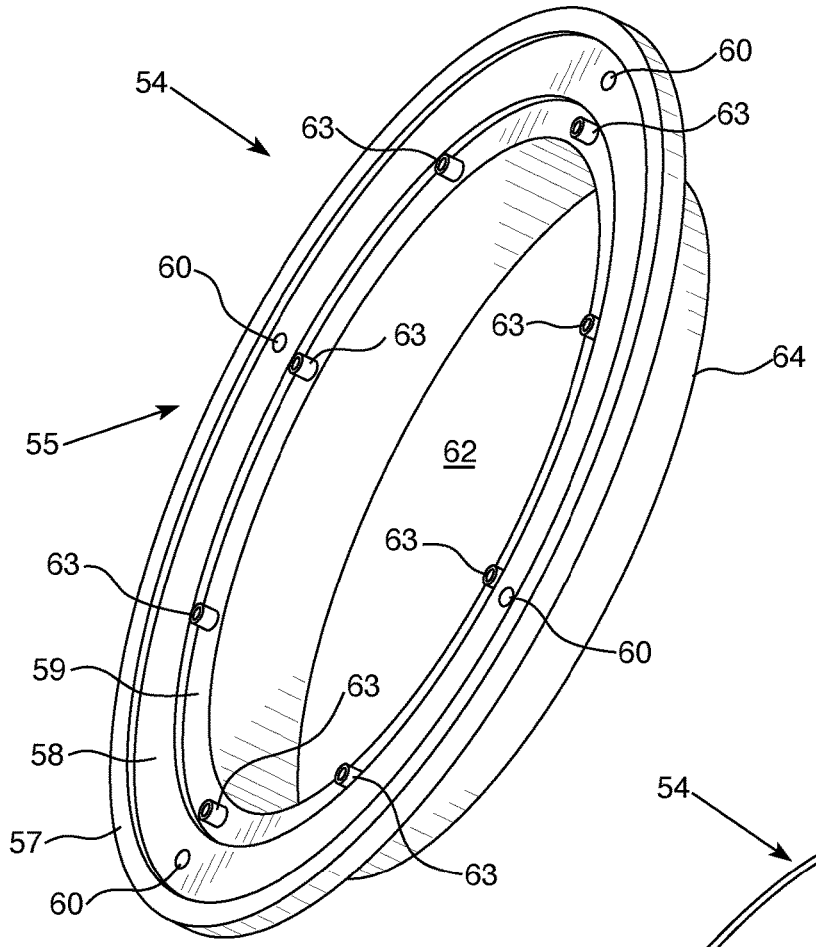
FIG. 5A shows an embodiment of a front side of a connector.
Figure 5B:
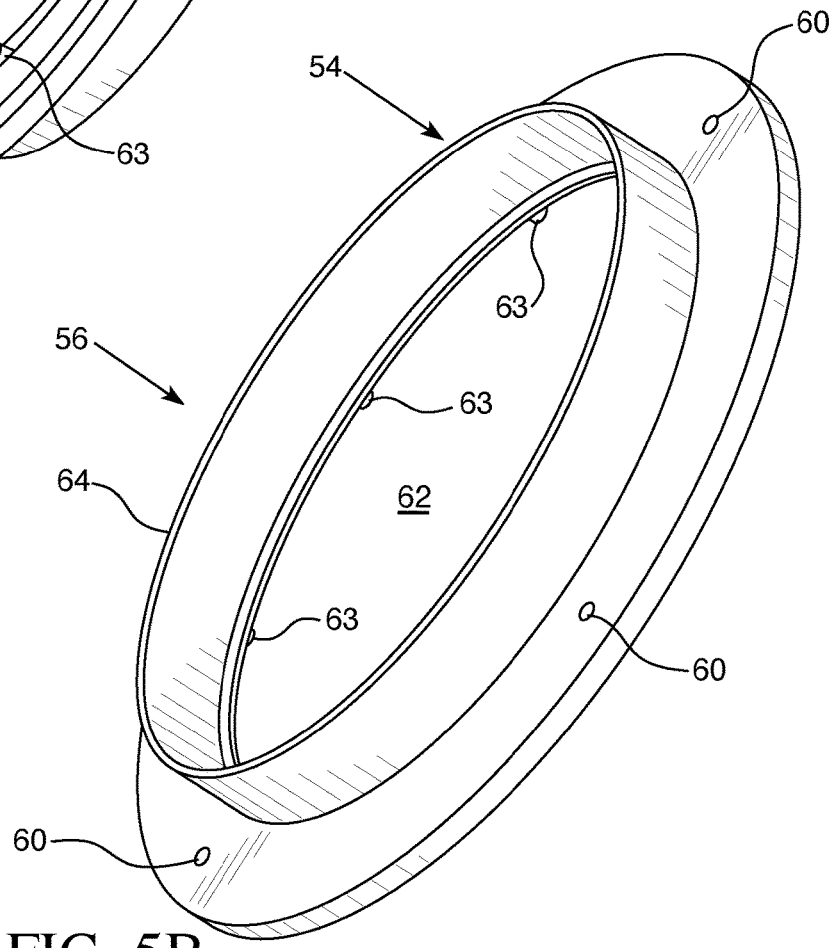
FIG. 5B shows an embodiment of a back side of a connector.

FIGS. 5A-5B show a nonlimiting embodiment of a connector. The connector 54 comprising a front side 55 and a back side 56. The front side 55 comprises three levels of rings, a top level 57, a middle level 58, and a bottom level 59. The top level 57 can be used to secure a faceplate, the middle level 58, being comprised of holes 60 to be used with an attachment means to secure a sectional half of the pet portal to a base, and the bottom level 59, being a ring with an elliptical opening 62 and having cylindrical protrusions 63, on the ring. The backside 56 of connector 54 is a tube 64. When used in the pet portal, the tube of the connectors can be the same size and abut together within a base to form a trap tunnel in a mirrored configuration; or one tube can be slightly bigger (or slightly smaller) than its partnered tube to accommodate a nested (inserted) configuration.

Figure 6A:
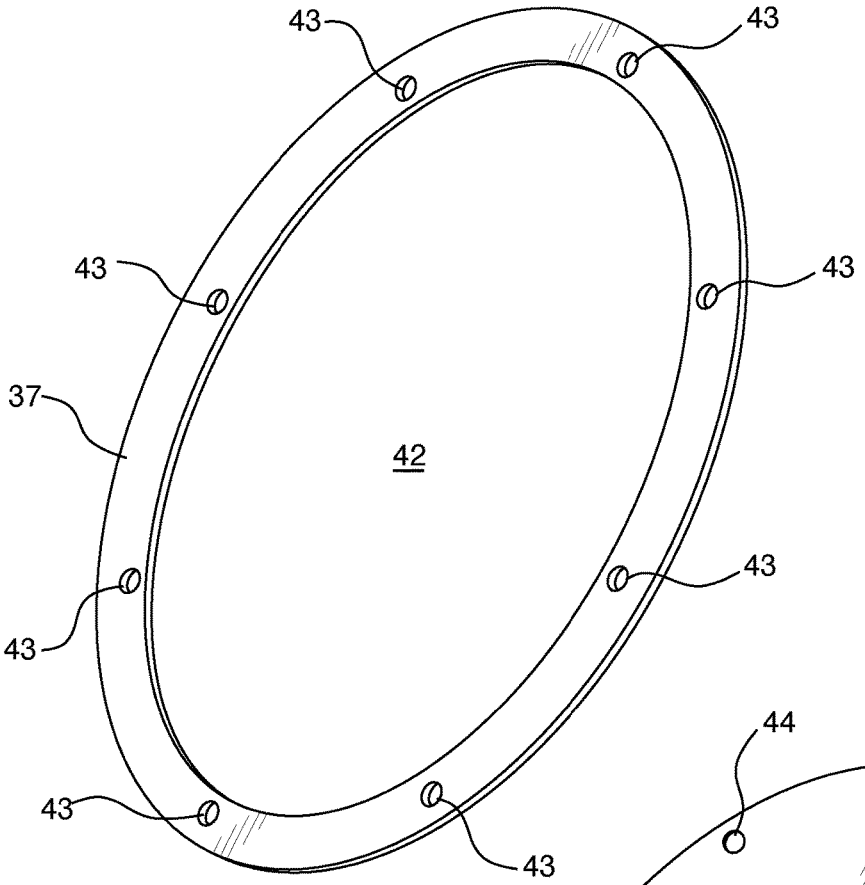
FIG. 6A shows an embodiment of a baffle support ring.
Figure 6B:
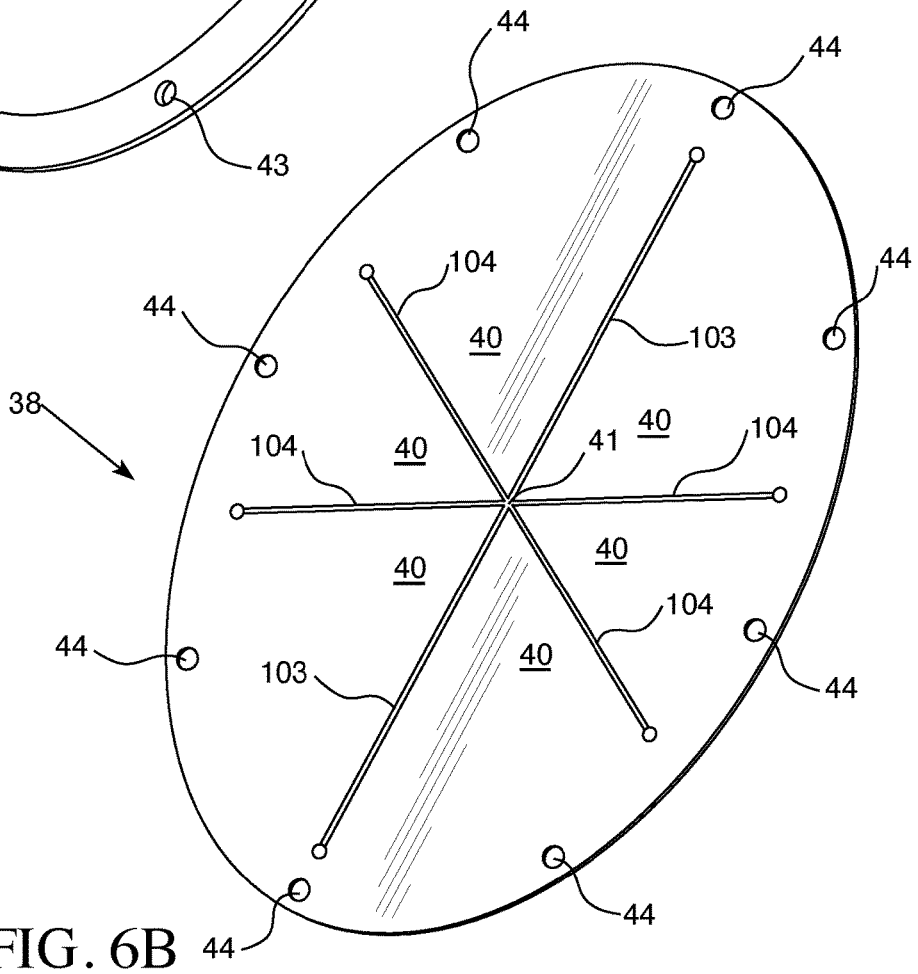
FIG. 6B shows a first embodiment of a baffle sheet.
Figure 6C:
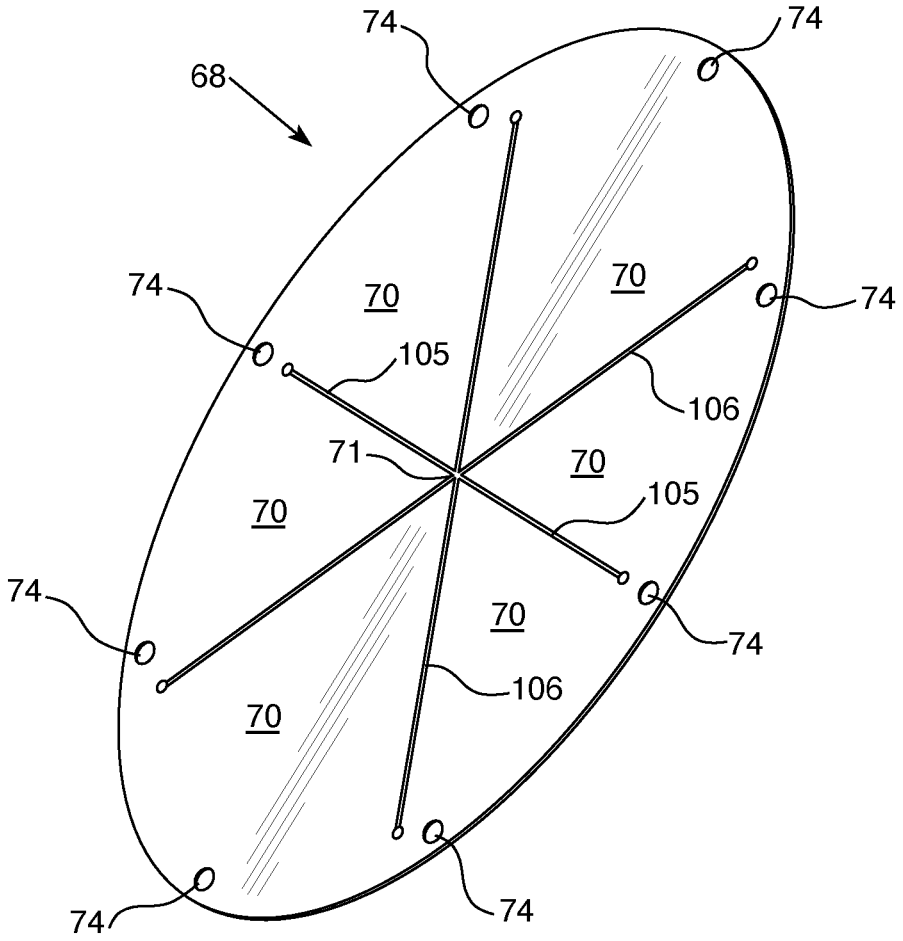
FIG. 6C shows a second embodiment of a baffle sheet.

FIG. 6A shows a nonlimiting embodiment of a baffle support ring 37 having an elliptical opening 42 and a plurality of holes 43 that align with a plurality of holes (44, 74) on each baffle sheet (38, 68), as shown in FIGS. 6B and 6C. FIGS. 6B and 6C show nonlimiting embodiments of baffle sheets (38, 68), here shown as each sheet having six triangular flaps (40, 70). In the pet portal, as seen in FIG. 7A, the baffle sheets (113 and 114, 117 and 118) are dual sets and are placed directly adjacent to one another, being flush. As more clearly shown in FIGS. 6B and 6C, the cuts for each baffle sheet differ, causing the triangular flaps (40, 70) of each sheet (38, 68) to be offset from one another. FIG. 6B discloses a vertical cut 103 and a horizontal x-cut 104 forming the triangular flaps 40, which all meet at center point 41 when in a closed orientation. FIG. 6C discloses a horizontal cut 105 and a vertical x-cut 106 forming the triangular flaps 70, which all meet at center point 71 when in a closed orientation. The triangular flaps of the baffle sheets are biased to be in a closed position except when an animal walks through them.

Figure 8:
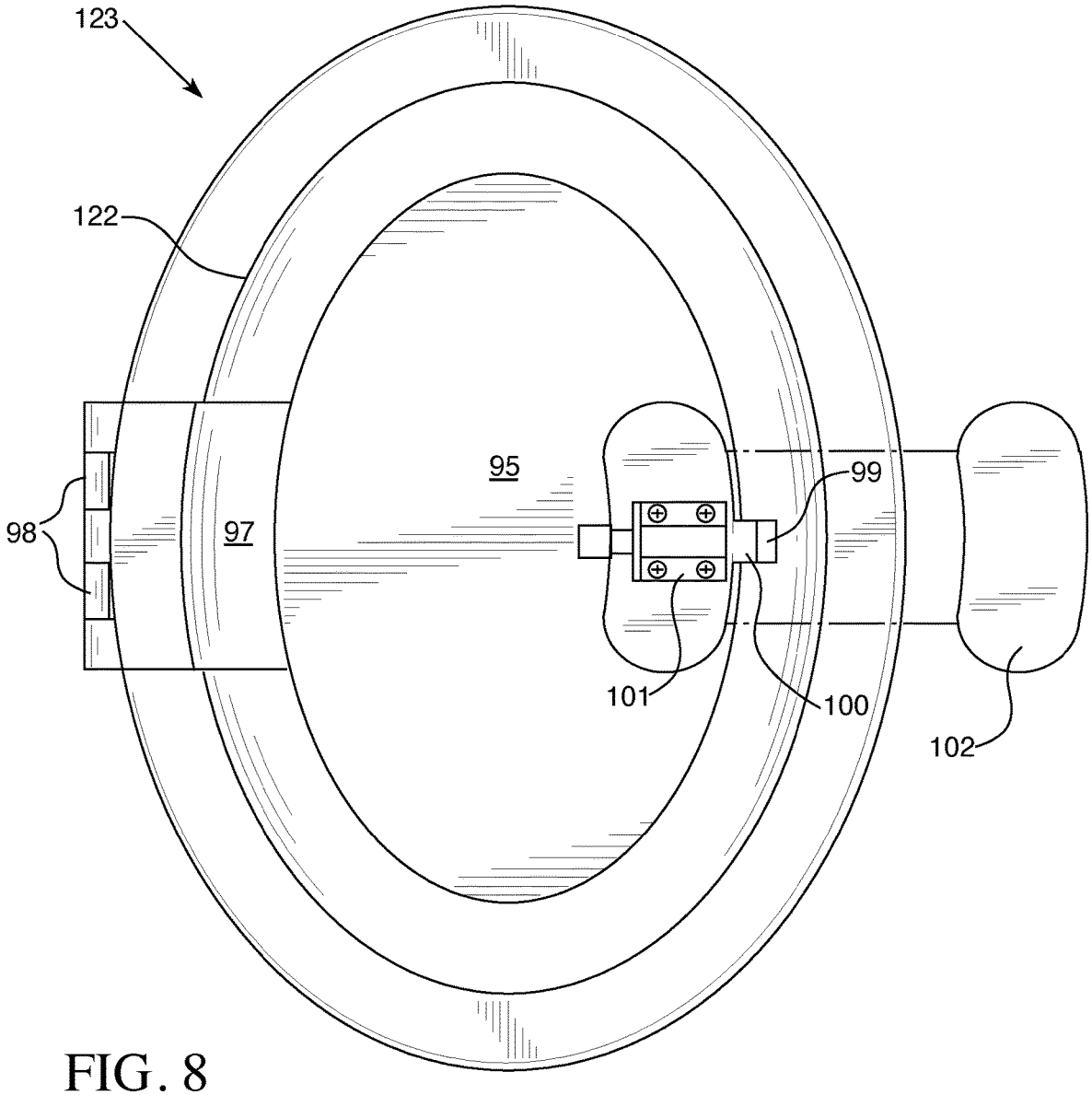
FIG. 8 shows an embodiment of a faceplate with a door.

FIG. 8 shows a nonlimiting configuration where a faceplate is also comprised of a door. Faceplate 123 with contoured convex ring 122 is attached to door 95 via hinge 97. The door 95 can be locked into a closed position using a slide-lock system 101 using slide-bolt latch 100, where slide-bolt latch 100 is received by recess 99. Optionally, hard cover 102 can be used to cover up the slide-lock system 101.

Typically, the base insert can fit into a single hung or double hung window opening or into an opening cut-out of a door acting as a base. The base insert can be any material, including various polymers, wood, treated wood, or a rust-resistant metal, and any material suitable for use in this disclosure. Preferably, the frame or sectional halves are comprised of a durable polycarbonate or any other high-impact plastic such as acrylonitrile butadiene styrene, nylon, polypropylene, etc. The frame or sectional halves need to be durable, sturdy, weather resistant, and capable of receiving the baffle material sheet with a baffle opening; said baffle material sheet being comprised of flexible insulating material. If a frame/sectional half/base has exterior and interior pieces, the exterior frame/sectional half/base and interior frame/base can be comprised of the same material or comprised of different materials if the end user wishes for either piece to better match the side of the door/wall or window to which it is attached. Attachment of the frame/sectional half to a base insert or to a door can be done by any means known to those with skill in the art. Alternatively, a pet portal unit can be fitted to insert into a hole cut in a door or a wall.

The baffle sheet material is comprised of a flexible and pet-safe material; some nonlimiting examples could be silicon or a thermoplastic rubber. The flexible material could also be insulating, and the material may be a dual composition comprising an interior insulation covered with an outer layer to contain the insulation and to provide structure to form the baffle design. Other insulating materials may be comprised of a single composition that both insulates and provides structure to form the baffle design. The baffle sheet material, whether single composition or dual composition, needs to be flexible enough to allow a small animal (up to 32 lbs.) to easily pass through, but rigid enough to spring back into a fully closed orientation. The size and shape of the baffle opening formed by the plurality of triangular flaps can vary based on the size/shape of the animal the portal is intended for. Preferably, the outer layer of the insulating material or the single composition insulating material is also durable and weather resistant. Some nonlimiting examples of single composition flexible insulating materials include various rubber and vinyl formulations. Some nonlimiting examples of interior insulation include polyethylene bubble film, polyester fiber batting, jute-fiber batting, cotton batting, fiberglass, wool, cellulose, or flexible foam. Some nonlimiting examples of an outer-layer composition include a metal/foil outer layer, denim, or any viable type of flexible polymer.

After installation of the pet portal, pets can freely move through the baffle opening. While not in use the baffle opening remains in the closed orientation blocking out the weather and flying insects. The pet portal doesn't require human interaction or accessories such as magnets, mechanical means, etc. for the pet portal to function properly. The claimed invention offers improvements over previous designs. There are two sets of dual flush baffle sheets forming a trap tunnel, the trap tunnel being superior to protecting a residence from the outdoor environment. The dual baffle sheets are a simple, yet elegant design having the triangular flaps being offset from one another by merely cutting out the triangular flaps in a strategic manner, nonlimiting examples being shown in FIGS. 6B-6C. The baffle sheet designs also allow for more efficient closure of the triangular flaps. The claimed device is also designed so that the traversing animal is only ever exposed to rounded smooth surfaces and not any edges per se, which could catch the animal's fur and cause harm or pain to the animal.

Although the above illustrative embodiments of the claimed invention have been described herein with reference to the accompanying drawings, it is to be understood that the invention is not limited to those precise embodiments, and that various other changes and modifications may be affected therein by one skilled in the art, without departing from the scope or spirit of the invention. Accordingly, the drawings and description are to be regarded as illustrative in nature, and not as restrictive.

The invention claimed is:

1. A pet portal comprising:

a first sectional half and a second sectional half, the first sectional half and the second sectional half cooperating to form an elliptical channel through a base;

the first sectional half comprising a first faceplate, a first connector, a first baffle support ring, and a first set of dual flush baffle sheets, each baffle sheet of the first set of dual flush baffle sheets comprising a plurality of triangular flaps that are cut so that all central vertexes of the triangular flaps meet at a center point of their respective baffle sheet to form a flexible barrier when their respective baffle sheet is in a closed orientation; the triangular flaps of each of the baffle sheets of the first set of dual flush baffle sheets being offset from one another respectively, the first baffle support ring having an elliptical opening and a plurality of holes that align with a plurality of holes on each baffle sheet of the first set of dual flush baffle sheets;

the first faceplate comprising a front side and a back side, the front side of the first faceplate being a contoured convex ring forming a relief down to an elliptical opening, the elliptical opening of the contoured convex ring of the first faceplate aligning with the elliptical opening of the first baffle support ring and the triangular flaps of each baffle sheet of the first set of dual flush baffle sheets; the back side of the first faceplate comprising a recess with a first circumference being a deep-side barrier and a second circumference being a short-side barrier, the back side of the first faceplate also comprising a plurality of holders allowing the first faceplate to be reversibly secured to the first connector;

the first connector comprising a front side and a back side, said front side of the first connector comprised of three levels of rings, a top level, a middle level, and a bottom level; the top level of the front side of the first connector being used to secure the first faceplate, the middle level of the front side of the first connector being comprised of a plurality of holes to be used with an attachment means to secure the first sectional half to a first side of the base, and the bottom level of the front side of the first connector being a ring with an elliptical opening that aligns with the elliptical opening of the contoured convex ring of the first faceplate, the elliptical opening of the first baffle support ring and the triangular flaps of each baffle sheet of the first set of dual flush baffle sheets, and the bottom level of the front side of the first connector having cylindrical protrusions on the ring that align with the plurality of holes on the first baffle support ring and the plurality of holes on each baffle sheet of the first set of dual flush baffle sheets; said bottom level of the front side of the first connector accommodating the first baffle support ring and the first set of dual flush baffle sheets, the first baffle support ring and the first set of dual flush baffle sheets being reversibly attached to the middle ring, the back side of the first connector being a tube;

the second sectional half comprising a second faceplate, a second connector, a second baffle-support ring, and a second set of dual flush baffle sheets, each baffle sheet of the second set of dual flush baffle sheets comprises a plurality of triangular flaps that are cut so that all central vertexes of the triangular flaps meet at a center point of their respective baffle sheet to form a flexible barrier when their respective baffle sheet is in a closed orientation; the triangular flaps of each of the baffle sheets of the second set of dual flush baffle sheets being offset from one another respectively, the second baffle support ring having an elliptical opening and a plurality of holes that align with a plurality of holes on each baffle sheet of the second set of dual flush baffle sheets;

the second faceplate comprising a front side and a back side, the front side of the second faceplate being a contoured convex ring forming a relief down to an elliptical opening, the elliptical opening of the contoured convex ring of the second faceplate aligning with the elliptical opening of the second baffle-support ring and the triangular flaps of each baffle sheet of the second set of dual flush baffle sheets; the back side of the second faceplate comprising a recess with a first circumference being a deep side barrier and a second circumference being a short side barrier; the back side of the second faceplate also comprising a plurality of holders allowing the second faceplate to be reversibly secured to the second connector;

the second connector comprising a front side and a back side, said front side of the second connector comprising three levels of rings, a top level, a middle level, and a bottom level, the top level of the front side of the second connector being used to secure the second faceplate, the middle level of the front side of the second connector comprising a plurality of holes to be used with an attachment means to secure the second sectional half to a second side of the base, and the bottom level of the front side of the second connector being a ring with an elliptical opening that aligns with the elliptical opening of the contoured convex ring of the second faceplate, the elliptical opening of the second baffle support ring and the triangular flaps of each baffle sheet of the second set of dual flush baffle sheets and having cylindrical protrusions on the ring that aligns with the plurality of holes on each of the second baffle support ring and each baffle sheet of the second set of dual flush baffle sheets; said bottom level of the front side of the second connector accommodating the second baffle support ring and the second set of dual flush baffle sheets, with the second baffle support ring and the second set of dual flush baffle sheets being reversibly attached to the middle ring, the back side of the second connector being a tube;

the respective back side tubes of the first sectional half and the second sectional half cooperating within the base to form a trap tunnel, aligning and connecting all the respective elliptical openings forming the elliptical channel of the pet portal.

2. The pet portal of claim 1, wherein either one or both of the first faceplate or the second faceplate further comprises a door, sized to cover the elliptical opening of either one or both of the first faceplate or the second faceplate, and wherein the front side of either one or both of the first faceplate and the second faceplate further comprise a first recess on a first circumference of the contoured convex ring opening sized and shaped to accommodate a door hinge, said first recess having cylinder-shaped insets to accommodate said door hinge and wherein the front side of either one or both of the first faceplate and the second faceplate further comprise a second recess in a relief down to form an elliptical opening to accommodate a slide-bolt latch of the door.

3. The pet portal of claim 2, whereby the door of either one or both of the first faceplate or the second faceplate is a spring-load door system.

4. The pet portal of claim 1, wherein the base is a door of a house or similar structure.

5. The pet portal of claim 1, wherein the base is a window insert.

6. The pet portal of claim 1, wherein the base is a wall within a house or similar structure.

* * * * *